US009145877B2

(12) United States Patent
Viegas

(10) Patent No.: US 9,145,877 B2
(45) Date of Patent: Sep. 29, 2015

(54) COMPRESSOR UNLOADING DEVICE

(75) Inventor: Herman H. Viegas, Bloomington, MN (US)

(73) Assignee: THERMO KING CORPORATION, Minneapolis, MN (US)

( * ) Notice: Subject to any disclaimer, the term of this patent is extended or adjusted under 35 U.S.C. 154(b) by 853 days.

(21) Appl. No.: 13/302,805

(22) Filed: Nov. 22, 2011

(65) Prior Publication Data

US 2013/0129530 A1 May 23, 2013

(51) Int. Cl.

| | |
|---|---|
| ***F04B 49/00*** | (2006.01) |
| ***F01D 15/12*** | (2006.01) |
| ***F04B 35/04*** | (2006.01) |
| ***F04C 29/00*** | (2006.01) |

(52) U.S. Cl.

CPC ..... *F04B 35/04* (2013.01); *F04C 29/005* (2013.01)

(58) Field of Classification Search

CPC ..... F04B 35/04; F04C 29/005
USPC ..... 417/223, 362, 374
See application file for complete search history.

(56) References Cited

U.S. PATENT DOCUMENTS

| | | | | |
|---|---|---|---|---|
| 3,367,562 | A | 2/1968 | Persson et al. | |
| 3,778,192 | A | 12/1973 | Caffrey | |
| 4,871,299 | A | 10/1989 | Hrabal | |
| 4,901,837 | A | 2/1990 | Wheeler | |
| 4,943,216 | A | 7/1990 | Iio | |
| 5,048,302 | A | 9/1991 | Hagenlocher et al. | |
| 5,048,657 | A | 9/1991 | Dissett et al. | |
| 5,207,072 | A | 5/1993 | Arno et al. | |
| 5,252,874 | A | 10/1993 | Viegas | |
| 5,609,232 | A | 3/1997 | Brownfield et al. | |
| 5,664,656 | A | 9/1997 | Dissett | |
| 5,915,513 | A * | 6/1999 | Isley et al. | 192/35 |
| 5,975,860 | A | 11/1999 | Obayashi et al. | |
| 6,209,700 | B1 | 4/2001 | Wogaman et al. | |
| 6,210,132 | B1 * | 4/2001 | Shiinoki et al. | 417/410.5 |
| 6,234,769 | B1 | 5/2001 | Sakai et al. | |
| 6,247,899 | B1 * | 6/2001 | Ban et al. | 417/16 |
| 6,375,436 | B1 * | 4/2002 | Irie et al. | 417/223 |
| 6,860,730 | B2 | 3/2005 | Leppanen | |
| 7,040,102 | B2 | 5/2006 | Higashiyama et al. | |
| 7,281,909 | B2 | 10/2007 | Uno et al. | |
| 7,540,719 | B2 * | 6/2009 | Umemura | 417/223 |
| 7,732,959 | B2 | 6/2010 | Pardee | |

FOREIGN PATENT DOCUMENTS

| | | | | |
|---|---|---|---|---|
| CN | 201265501 | | 7/2009 | |
| GB | 2127913 A | * | 4/1984 | F16D 27/04 |
| JP | 2003238859 | | 8/2003 | |
| KR | 10-0975831 | | 8/2010 | |

OTHER PUBLICATIONS

PCT/US2012/063498 International Search Report and Written Opinion dated Mar. 26, 2013 (8 pages).

Yeung et al., Automobile Hybrid Air Conditioning Technology, 2009 3rd International Conference on Power Electronic Systems and Applications, K2105090118, 5 pages.

* cited by examiner

*Primary Examiner* — Peter J Bertheaud
*Assistant Examiner* — Dominick L Plakkoottam
(74) *Attorney, Agent, or Firm* — Hamre, Schumann, Mueller & Larson, P.C.

(57) ABSTRACT

A refrigerant compressor system including a prime mover, a compressor, and an unloader device that couples the compressor to the prime mover. The unloading device includes a centrifugal clutch and an electric clutch.

21 Claims, 3 Drawing Sheets

COMPRESSOR UNLOADING DEVICE

BACKGROUND

The present invention relates to refrigerant compressor systems. More particularly, the invention relates to unloaders or clutches for coupling a compressor with a prime mover. Further, the invention includes aspects of electric clutches and centrifugal clutches.

SUMMARY

In one embodiment, the invention provides a transport refrigeration system that includes a prime mover, a compressor configured to compress a refrigerant, and an unloader device selectively coupling the compressor to the prime mover. The unloading device includes first and second clutches coupled in series between the prime mover and the compressor. The prime mover drives the compressor when the prime mover is running and the first and second clutches are engaged, and the prime mover is unable to drive the compressor when at least one of the first and the second clutches is disengaged.

In another embodiment the invention provides a compressor unloading device for coupling a compressor to a prime mover and an electric motor. The prime mover includes a prime mover housing and a drive shaft. The compressor includes a compressor housing and a compressor shaft. The electric motor is coupled to the compressor unloading device via a belt. The compressor unloading device includes a housing that defines a prime mover flange for coupling to the prime mover housing and a compressor flange for coupling to the compressor housing. A centrifugal clutch is positioned within the housing and includes a prime mover rotor rigidly coupled to the drive shaft and an output member that is selectively coupled to the prime mover rotor for rotation therewith. The output member defines a pulley that engages the belt. An electric clutch is positioned within the housing and includes an armature plate that is slidably coupled to the output member for rotation therewith. A compressor rotor is rigidly coupled to the compressor shaft for rotation therewith, and a selectively energizable electromagnetic coil is coupled to the compressor housing. The armature plate is selectively engagable with the compressor rotor to transmit rotation of the output member to the compressor shaft. The compressor housing is uncouplable from and thereafter movable relative to the housing such that the compressor, the electromagnetic coil, and the compressor rotor are moved away from the housing and the armature plate thereby defining a space between the compressor rotor and the armature plate through which the belt may be removed without completely disengaging the compressor from the housing.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
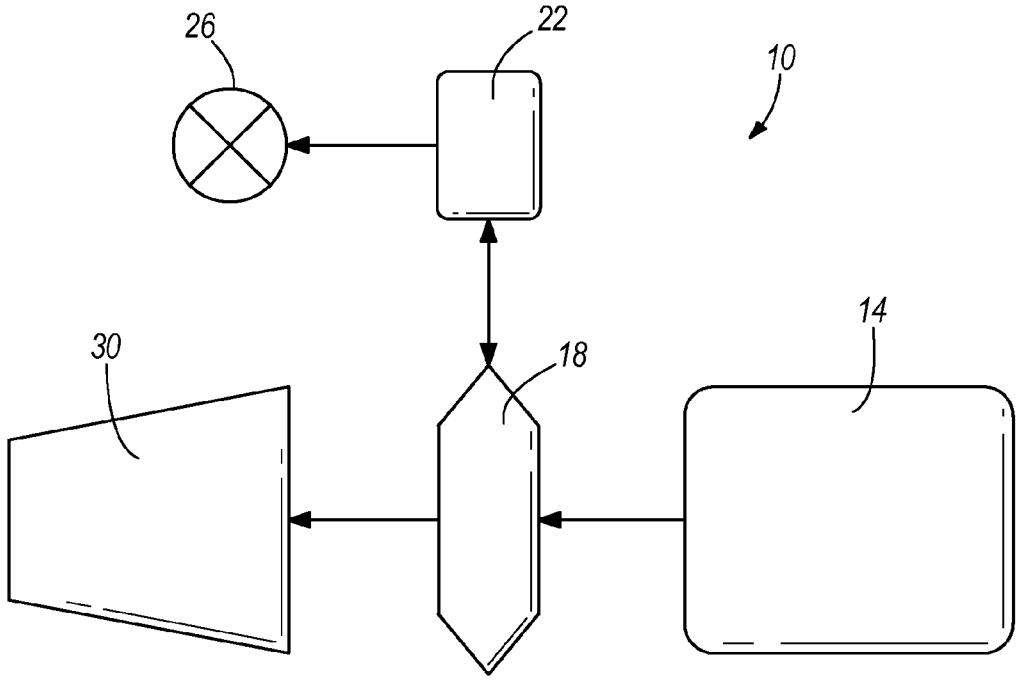
FIG. 1 is a schematic representation of a transport refrigeration system including a compressor unloading device.

FIG. 1 shows a schematic representation of a transport refrigeration system 10 that includes a prime mover in the form of an internal combustion engine such as a diesel engine 14, an unloading device 18, an electric motor 22, an accessory device such as evaporator and or condenser fans 26, and a compressor 30. The transport refrigeration system 10 works generally as is known in the art. That is to say, the compressor 30 compresses a liquid refrigerant, the refrigerant then passes through a condenser, an expansion device, and an evaporator before returning to the compressor 30. The fans 26 and other accessory devices such as an alternator, driers, economizers, variable valves, and other accessories operate within the transport refrigeration system to provide temperature control within a temperature controlled space. Typical installations of the transport refrigeration system 10 include trailer refrigeration units, onboard truck refrigeration units, container refrigeration units, or other refrigeration units. The prime mover may be positioned within the transport refrigeration system 10 or it may be a vehicle engine within the engine compartment of the vehicle that is merely in communication (e.g., mechanical or electric) with the other components of the transport refrigeration system.

Generally, the prime mover provides power to the unloading device 18 which in turn selectively provides power to the compressor 30. The electric motor 22 provides power to the unloading device 18 when the prime mover is unavailable and provides power to the accessory device. Alternatively, the electric motor 22 is powered by the prime mover via the unloading device 18. In another construction, the prime mover is shut off to reduce fuel consumption and the electric motor 22 is used to power the transport refrigeration system 10 either by battery, shore power, grid power, or another electric power source. For example, when the vehicle is parked and electric grid power is available, or the vehicle is traveling over water via ferry, often the electric motor 22 is used to power the transport refrigeration system 10. Detailed discussion of the structure and operation of the transport refrigeration system 10 follows below.

Figure 2:
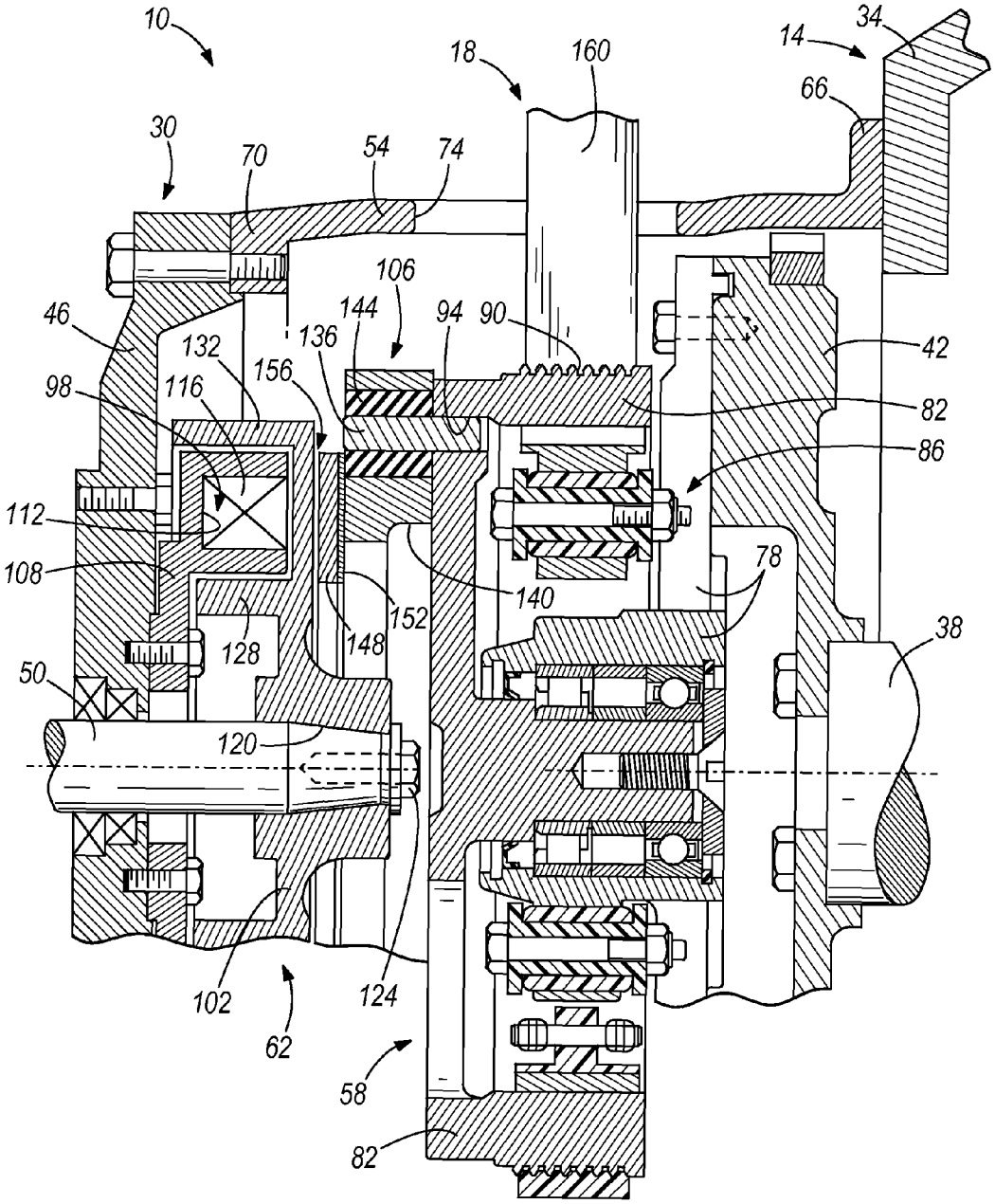
FIG. 2 is a section view of the compressor unloading device of FIG. 1.

Turning to FIG. 2, the internal combustion engine is preferably a diesel engine 14. In other constructions, a gasoline engine, or an electric motor may be used. The diesel engine 14 is the primary source of power for the transport refrigeration system 10. As further illustrated in FIG. 2, the diesel engine 14 includes an engine housing 34 and a drive shaft 38 extending at least partially through the engine housing 34 and an engine flywheel 42 coupled to the unloading device 18.

The compressor 30 is preferably a reciprocating compressor but could be another compressor type (e.g., a scroll, screw, linear or other compressor type). The compressor 30 includes a compressor housing 46 and a compressor shaft 50 extending at least partially through the compressor housing 46. The compressor 30 is powered to provide compressed refrigerant to a refrigeration system (not shown).

The unloading device 18 includes an unloader housing 54, a first clutch such as a centrifugal clutch 58, and a second clutch such as an electric clutch 62. The unloader housing 54 defines an engine flange 66, a compressor flange 70, and a drive belt aperture 74. The engine flange 66 couples the unloader housing 54 to the engine housing 34 and the compressor flange 70 couples the unloader housing 54 to the compressor housing 46.

The centrifugal clutch 58 includes a flywheel rotor 78 fastened to the engine flywheel 42, an output member 82, and clutch components 86 positioned therebetween. The centrifugal clutch 58 operates as understood by those skilled in the art. Any suitable centrifugal clutch 58 may be chosen within the operating parameters of the system. Generally, the centrifugal clutch 58 selectively transmits rotational power from the drive shaft 38 to the output member 82 dependant at least in part on the rotational velocity of the drive shaft 38. The output member 82 includes an annular belt pulley 90 and a plurality of pin apertures 94 spaced around the perimeter of the output member 82.

The electric clutch 62 includes a coil assembly 98, a compressor rotor 102, and an armature plate assembly 106. The coil assembly 98 includes a casing 108 with a mounting portion for rigidly coupling to the compressor housing 46 and two annular projections forming an annular coil groove 112 therebetween. The projections extend away from the mounting portion and an electromagnetic coil 116 is positioned in the annular coil groove 112. The electromagnetic coil 116 is selectively energizable to create a magnetic field.

The compressor rotor 102 is rigidly coupled to the compressor shaft 50 for rotation therewith. The compressor rotor 102 includes a central aperture 120 shaped to mate with the compressor shaft 50 to hold the compressor rotor 102 rigidly in place with a bolt or cap screw 124. The compressor rotor 102 includes an inner annular projection 128 radially inside the annular coil groove 112 and an outer annular projection 132 radially outside the annular coil groove 112. The inner and outer annular projections 128, 132 extend toward the compressor 30 such that the annular coil groove 112 and the inner and outer annular grooves 128, 132 overlap in an axial direction. The compressor rotor 102 is ferromagnetic.

The armature plate assembly 106 includes a plurality of dowel pins 136 received in and extending from the pin apertures 94. The surface of each dowel pin 136 is smoothed or polished. A drive plate 140 defines an annular ring about the perimeter of the output member 82 of the centrifugal clutch 58 and is coupled to the dowel pins 136 via elastomeric bushings 144 such that the drive plate 140 can slide axially along the dowel pins 136. The elastomeric bushings 144 take up any shaft misalignment that may exist or develop. A ferromagnetic armature plate 148 is mounted to the drive plate 140 via a non-ferrous spacer plate 152. The illustrated spacer plate 152 is aluminum and serves to stop any leakage of magnetic flux therethrough. The armature plate 148 is spaced from the compressor rotor 102 by a nominal air gap 156. The illustrated air gap 156 is about 0.030 inches although other gaps are considered. In other embodiments, the bushings 144 may be fit into the output member 82 and the pins 136 are a part of the drive plate 140.

A belt 160 engages the belt pulley 90 of the centrifugal clutch 58 and further engages the electric motor 22. The illustrated belt 160 is a flat style belt with grooves formed on one side. The belt pulley 90 has a corresponding shape for improving engagement between the belt pulley 90 and the belt 160. In other constructions, different belt profiles may be used, as desired.

The electric motor 22 includes a motor shaft (not shown) coupled to the belt 160 and the fan 26. When the diesel engine 14 is operational, the belt 160 turns the motor shaft and the motor shaft is used as a jack shaft to operate the fan 26. When the diesel engine 14 is not operating, the electric motor 22 can be operated to turn the fan 26 and the output member 82 of the centrifugal clutch 58 to operate the compressor 30. In other arrangements, the electric motor 22 may operate as a generator when the diesel engine 14 is operational and power the fan 26 via generated electricity. Further, other accessory devices may exist and be powered either mechanically or electrically by the electric motor 22.

In operation, the diesel engine 14 is started and as the rotational speed of the drive shaft 38 increases the centrifugal clutch 58 engages and begins to turn the output member 82. Rotation of the output member 82 also powers the motor shaft and therefore the fan 26 via the belt 160. When the refrigeration system demands cooling, electricity is supplied to the electromagnetic coil 116 such that the armature plate assembly 106 slides on the dowel pins 136 to close the air gap 156 and engage the compressor rotor 102 such that movement of the output member 82 is translated to the compressor rotor 102 to operate the compressor 30. When the electric clutch 62 is disengaged the magnetic force holding the armature plate 148 is broken and the armature plate assembly 106 freewheels in place. The armature plate assembly 106 may slide on the dowel pins 136 away from the compressor rotor 102 but it is not detrimental to either the compressor rotor 102 or the armature plate 148 if it stays in close proximity to the compressor rotor 102.

Alternately, in a standby mode, the electric motor 22 is operated while the diesel engine 14 is not running. The electric motor 22 turns the fan 26 and the output member 82 of the centrifugal clutch 58. The rest of the transport refrigeration system 10 functions the same. In other words, the electric motor 22 turns the output member 82, the electric clutch 62 is engaged, and the compressor shaft 50 is rotated to power the compressor 30. The compressor then compresses the refrigerant for providing cooling within the temperature controlled space. When the system exits stand-by mode because the temperature controlled space requires more cooling than provided in the stand-by mode, the vehicle begins travelling over the road, or another reason, the diesel engine 14 provides power to the transport refrigeration system 10 and the electric motor 22 is again used as a jack shaft to power the fan 26 and/or other accessories. In one embodiment, a driver or operator of the vehicle will manually switch the system between stand-by and regular operation.

During operation, the compressor shaft 50 can be engaged substantially immediately when the diesel engine 14 starts or a time delay can be used such that the electric clutch 62 engages a predetermined time after startup.

After about 50 thousand engagement/disengagement cycles, the air gap 156 will have increased as the interface surfaces of the compressor rotor 102 and armature plate 148 wear. When the air gap 156 has increased to a predetermined value, the compressor rotor 102 and armature plate 148 are replaced. In some cases, an additional spacer plate 152 or a thicker spacer plate 152 may be installed in place of replacing the compressor rotor 102 and armature plate 148 to extend the life of the current parts installed in the system, such that the air gap 156 is brought within the desired specifications.

Figure 3:
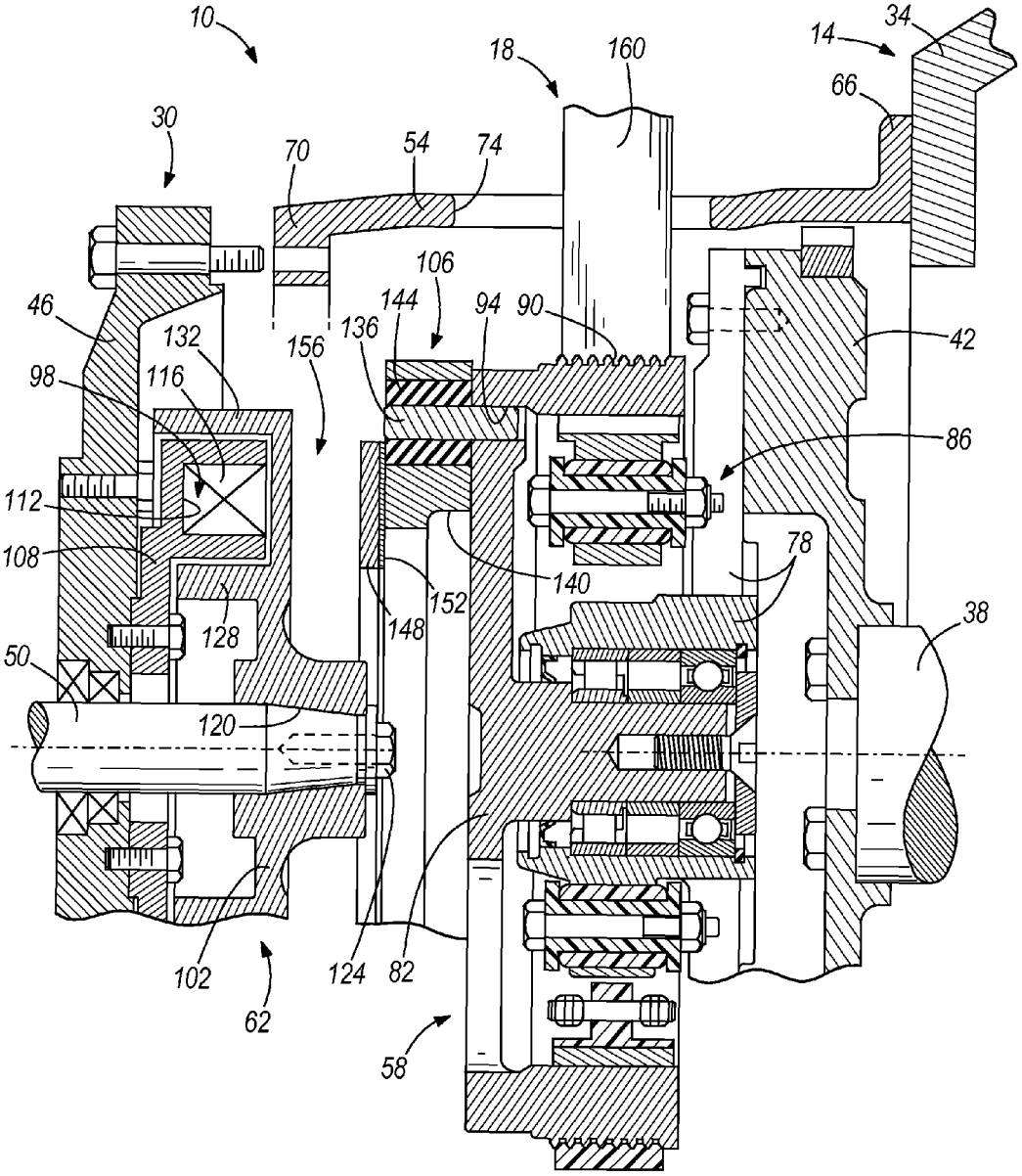
FIG. 3 is a section view of the unloading device of FIG. 1, illustrating a belt replacement arrangement.

Turning to FIG. 3, the belt 160 wears during operation and occasionally needs to be replaced. To replace the belt 160, the compressor fasteners are removed such that the compressor housing 46 is decoupled from the unloading device 18. The compressor 30, with the coil assembly 98 and the compressor rotor 102 attached, is then slid away from the unloading device 18. In the preferred embodiment, the unloader housing 54 includes three or four slide pins (not shown) that extend from the compressor flange 70 toward the compressor 30. The compressor housing 46 includes apertures (not shown) sized to receive the slide pins. The slide pins allow the compressor 30 to be easily located on the unloader housing 54 and support the compressor 30 when it is slid away from the unloader housing 54 during a belt replacement operation. In other constructions, shoulder bolts or threaded pins may be used in place of the slide pins to inhibit full removal of the compressor 30 from the unloader housing 54.

To remove the belt 160, the compressor 30 is moved about one-half inch away from the unloading device 18 as shown in FIG. 3. The belt 160 is then loosened by moving a tensioner (not shown) or by moving the electric motor 22 toward the unloading device 18. The belt 160 is then removed through the gap formed between the compressor rotor 102 and the armature plate assembly 106 (i.e., the air gap 156 is increased by about one-half inch such that the belt 160 may be removed therethrough). The belt 160 can be removed by manipulation from outside the drive belt aperture 74 or with a specialized tool. A new belt 160 may then be installed and the compressor 30 reinstalled to the unloader housing 54.

The invention allows a user to execute a finer temperature control with the associated refrigeration system. The combination of the electric clutch 62 and the centrifugal clutch 58 provides several advantages over the prior art. The invention allows the diesel engine 14 to run continuously to provide air flow in the refrigeration system via the fan 26, while unloading the compressor 30. This arrangement provides airflow during periods that the refrigeration system is not providing cooling.

Further, improved fuel economy can be realized because the transport refrigeration system 10 can be operated with the diesel engine 14 running continuously while loading and unloading the compressor 30 via the electric clutch 62 to provide On/Off refrigeration control. This is an advantage over the constant heat/cool mode used with existing systems. The invention provides for fewer operating hours on the compressor 30 for a given amount of total system operation, leading to an extended life of the compressor 30. The arrangement of the unloader device allows for easy installation and retrofit to existing units both in a shop and in the field. Other advantages are provided and will be apparent to those skilled in the art. The belt 160 replacement operation is easier than with previous systems and allows a technician to replace the belt 160 without draining the compressor 30. In some cases, a technician would pump down the compressor 30 and fully remove it from the prime mover or unloading device for service. The manipulation necessary to access the service parts/feature required the technician to tilt or otherwise move the compressor such that it needed to be drained. The inventive arrangement eliminates this inconvenience.

Alternate heating methods (other than compressor hot gas) can be used with the invention. For example, the compressor 30 can be disengaged and electric power can be used for heating and/or defrosting. This allows the system to operate in a heating mode without operating a condenser fan of the refrigeration system, leading to further fuel economy.

Various features and advantages of the invention are set forth in the following claims.

What is claimed is:

1. A transport refrigeration system comprising:

a prime mover;

a compressor configured to compress a refrigerant; and an unloader device selectively coupling the compressor to the prime mover, the unloader device including a first clutch mechanism and a second clutch mechanism configured to operate independently from the first clutch mechanism, wherein the first clutch mechanism and the second clutch mechanism are coupled in series between the prime mover and the compressor, wherein the prime mover drives the compressor when the prime mover is running and the first clutch mechanism and the second clutch mechanism are each engaged, and wherein the prime mover is unable to drive the compressor when at least one of the first clutch mechanism and the second clutch mechanism is disengaged.

2. The transport refrigeration system of claim 1, further comprising a pulley, wherein the first clutch mechanism is coupled between the pulley and the prime mover, and further wherein the prime mover drives the pulley when the prime mover is running and the first clutch mechanism is engaged, and wherein the prime mover is unable to drive the pulley when the first clutch mechanism is disengaged.

3. The transport refrigeration system of claim 2, further comprising an electric motor having a motor shaft coupled to the pulley via a belt.

4. The transport refrigeration system of claim 3, wherein the second clutch mechanism is coupled between the pulley and the compressor, wherein the electric motor rotates the pulley and the compressor when the electric motor is running, the prime mover is not running, the first clutch mechanism is disengaged, and the second clutch mechanism is engaged.

5. The transport refrigeration system of claim 4, further comprising a fan coupled to the motor shaft, wherein the prime mover rotates the fan through the pulley, belt, and motor shaft when the prime mover is running.

6. The transport refrigeration system of claim 5, wherein the prime mover is a diesel engine.

7. The transport refrigeration system of claim 5, wherein the compressor is a reciprocating compressor.

8. The transport refrigeration system of claim 4, wherein the prime mover includes a drive shaft, the first clutch mechanism is a centrifugal clutch, and the second clutch mechanism is an electric clutch, wherein the compressor includes a compressor shaft, wherein the centrifugal clutch includes a flywheel plate coupled to the drive shaft and the pulley coupled to the flywheel plate, wherein the electric clutch includes an armature plate coupled to the pulley and a compressor rotor coupled to the compressor shaft, wherein the pulley selectively rotates in response to rotation of the flywheel plate, and wherein the compressor rotor is selectively engagable with the armature plate such that the compressor rotor rotates with the pulley.

9. The transport refrigeration system of claim 8, wherein the armature plate is separated from the compressor rotor by an air gap, the armature plate movable relative to the pulley to eliminate the air gap.

10. The transport refrigeration system of claim 9, wherein the electric clutch further includes an electromagnetic coil selectively energizable to create a magnetic field to engage the armature plate and the compressor rotor.

11. The transport refrigeration system of claim 10, wherein the armature plate includes a ferromagnetic plate, a non-ferrous spacer plate, and a drive plate slidably engaged with the pulley.

12. The transport refrigeration system of claim 11 wherein the drive plate is slidably coupled to the pulley on a plurality of dowel pins.

13. The transport refrigeration system of claim 12, wherein the drive plate is mounted on the dowel pins via elastomeric bushings.

14. A transport refrigeration system comprising:

a prime mover including a prime mover housing and a drive shaft;

an electric motor;

a compressor configured to compress a refrigerant, the compressor including a compressor housing and a compressor shaft; and a compressor unloading device for selectively coupling the compressor to the prime mover and the electric motor, wherein the electric motor is coupled to the compressor unloading device via a belt, the compressor unloading device including a housing defining a prime mover flange for coupling to the prime mover housing and a compressor flange for coupling to the compressor housing, a centrifugal clutch positioned within the housing and including a prime mover rotor rigidly coupled to the drive shaft and an output member selectively coupled to the prime mover rotor for rotation therewith, the output member defining a pulley that engages the belt, and an electric clutch positioned within the housing and including an armature plate slidably coupled to the output member for rotation therewith, a compressor rotor rigidly coupled to the compressor shaft for rotation therewith, and a selectively energizable electromagnetic coil coupled to the compressor housing, the armature plate selectively engagable with the compressor rotor to transmit rotation of the output member to the compressor shaft, wherein the compressor housing is uncouplable from and thereafter movable relative to the housing such that the compressor, the electromagnetic coil, and the compressor rotor are moved away from the housing and the armature plate thereby defining a space between the compressor rotor and the armature plate through which the belt may be removed without completely disengaging the compressor from the housing.

15. The compressor unloading device of claim 14, wherein the electromagnetic coil is selectively energizable to create a magnetic field to engage the armature plate and the compressor rotor.

16. The compressor unloading device of claim 5, wherein the armature plate includes a ferromagnetic plate, a non-ferrous spacer plate, and a drive plate slidably engaged with the output member.

17. The compressor unloading device of claim 14, wherein the drive plate is slidably coupled to the output member on a plurality of dowel pins.

18. The compressor system of claim 17, wherein the drive plate is mounted on the dowel pins via elastomeric bushings.

19. The compressor unloading device of claim 14, wherein the armature plate is separated from the compressor rotor by an air gap, the armature plate movable relative to the output member to eliminate the air gap.

20. The compressor unloading device of claim 14, wherein the electric clutch is operable independently of the centrifugal clutch.

21. A transport refrigeration system comprising:

a prime mover including a prime mover housing and a drive shaft;

an electric motor;

a compressor configured to compress a refrigerant, the compressor including a compressor housing and a compressor shaft; and a compressor unloading device for selectively coupling the compressor to the prime mover and the electric motor, wherein the electric motor is coupled to the compressor unloading device via a belt, the compressor unloading device including a housing defining a prime mover flange for coupling to the prime mover housing and a compressor flange for coupling to the compressor housing, a centrifugal clutch positioned within the housing and including a prime mover rotor rigidly coupled to the drive shaft and an output member selectively coupled to the prime mover rotor for rotation therewith, the output member defining a pulley that engages the belt, and an electric clutch positioned within the housing and operated independently of the centrifugal clutch, the electric clutch including an armature plate slidably coupled to the output member for rotation therewith, a compressor rotor rigidly coupled to the compressor shaft for rotation therewith, and an electromagnetic coil coupled to the compressor housing and selectively energizable to create a magnetic field to engage the armature plate and the compressor rotor to transmit rotation of the output member to the compressor shaft, wherein the armature plate includes a ferromagnetic plate, a non-ferrous spacer plate, and a drive plate slidably engaged with the output member on a plurality of dowel pins, wherein the compressor housing is uncouplable from and thereafter movable relative to the housing such that the compressor, the electromagnetic coil, and the compressor rotor are moved away from the housing and the armature plate thereby defining a space between the compressor rotor and the armature plate through which the belt may be removed without completely disengaging the compressor from the housing.

* * * * *